United States Patent [19]

Moldovan et al.

[11] Patent Number: 4,649,675

[45] Date of Patent: Mar. 17, 1987

[54] NONPENETRATING ROOF MOUNT FOR ANTENNA

[75] Inventors: Nicholas Moldovan, Newton; Bobby R. Hodges, Stony Point, both of N.C.

[73] Assignee: M/A-Com, Newton, N.C.

[21] Appl. No.: 797,202

[22] Filed: Nov. 12, 1985

[51] Int. Cl.[4] ..... E04H 12/18; H01Q 1/12

[52] U.S. Cl. ..... 52/27; 52/40; 52/292; 248/237; 248/523; 248/DIG. 10; 343/878; 343/880; 343/890

[58] Field of Search ..... 52/27, 40, 292; 248/237, 523, DIG. 10; 343/878, 880, 890

[56] References Cited

U.S. PATENT DOCUMENTS

| | | | |
|---|---|---|---|
| 1,679,675 | 8/1928 | Lujan | 248/DIG. 10 |
| 2,683,011 | 7/1954 | Haggerty | 248/122 |
| 2,853,706 | 9/1958 | Trench et al. | 343/880 |
| 2,920,846 | 1/1960 | Lingafelter | 52/27 X |
| 3,094,303 | 6/1963 | Belger | 248/40 |
| 3,223,387 | 12/1965 | Magliocco | 256/1 |
| 3,288,413 | 11/1966 | Gregory | 248/158 |
| 3,415,475 | 12/1968 | Goodman | 248/158 |
| 4,006,702 | 2/1977 | St. Cyr | 116/63 P |
| 4,086,599 | 4/1978 | VanderLinden, Jr. et al. X | 343/882 |
| 4,201,975 | 5/1980 | Marcus | 340/841 |

FOREIGN PATENT DOCUMENTS

| | | | |
|---|---|---|---|
| 2100328 | 1/1971 | Fed. Rep. of Germany | 248/DIG. 10 |
| 140003 | 8/1982 | Japan | 343/878 |
| 718556 | 2/1980 | U.S.S.R. | 52/292 |

*Primary Examiner*—Alfred C. Perham

*Attorney, Agent, or Firm*—Bell, Seltzer, Park & Gibson

[57] ABSTRACT

An apparatus for mounting an antenna on a flat roof without penetrating the waterproof membrane of the roof is disclosed herein. The apparatus is comprised of a rigid base having a planar lower surface adapted to overlie the flat roof, ballast means carried by the base to stabilize the base, and antenna support means connected to and extending upwardly from the base.

18 Claims, 6 Drawing Figures

NONPENETRATING ROOF MOUNT FOR ANTENNA

BACKGROUND OF THE INVENTION

This invention relates to antenna mounts generally, and particularly relates to antenna mounts for installing an antenna on a flat roof without penetrating the seal of the roof.

Commercial antenna installations on flat roof tops have traditionally been complex and expensive. This is primarily due to the wide variety of roof designs currently in use and the requirements which must be met to maintain both structural integrity and beam pointing factors after installation. Further complicating such installations is the need to waterproof or reseal the roof.

Typical flat roofs are of a lightweight construction, with widely spaced steel joists supporting wood or metal decking, and a waterproof seal overlying the decking. The usual spacing between the joists is about four feet. Installation of an antenna has typically required, first, locating either the joists or the girders that support the roof, and then providing a frame that secures the antenna directly to these joists or girders. Location of the antenna is therefore restricted to the location of these main supports, and connection of the antenna mount thus requires drilling through the roof into the structural members and connecting the mount to the structural members with bolts. Typically, these roofs are bonded by the roofing contractor against leakage for ten to twenty years—any installation that penetrates the waterproof membrane of the roof requires that the contractor reseal the roof to maintain the warranty.

With the increasing computerization of commercial information systems, and the attendant need to interconnect computers via satellites to form computer networks, there is an increasing need for roof-mounted satellite dish antennas. The mounts for such satellite dish antennas should be easily transportable and adaptable to a variety of different roofing structures. Moreover, such mounts should permit installation of the antenna without penetrating the seal of the roof, so that the need to reseal the roof to ensure the continued warranty of the roof is obviated.

Accordingly, it is one object of the invention to provide a roof antenna mount which does not require penetration of the roof.

It is a further object of the present invention to provide a nonpenetrating antenna mount which uniformly distributes the weight of the antenna on the roof, and therefore reduces any water ponding which might otherwise occur from a concentration of weight on the roof.

It is a still further object of the present invention to provide an inexpensive antenna mount which is lightweight, transportable, and easy to assemble.

SUMMARY OF THE INVENTION

In accordance with the present invention, applicant provides an antenna mount having a base which is of a knockdown construction. The base is formed from a plurality of frame members assembled to form a framework structure, and several cooperating panels mounted in the framework structure. An upright post extends from the framework for supporting the antenna. The panels which are installed in the base are of a rigid structural laminate construction, the undersides of which contact the roof surface. The base, once assembled, may be weighted with a solid or liquid ballast, and the large surface area of the base distributes the weight of the antenna and ballast over a large area of the roof.

BRIEF DESCRIPTION OF THE DRAWINGS

Other objects, features and advantages of the present invention will be made apparent from the following description of the preferred embodiments, and from the accompanying drawings, in which—

DETAILED DESCRIPTION OF THE PREFERRED EMBODIMENTS

Figure 1:
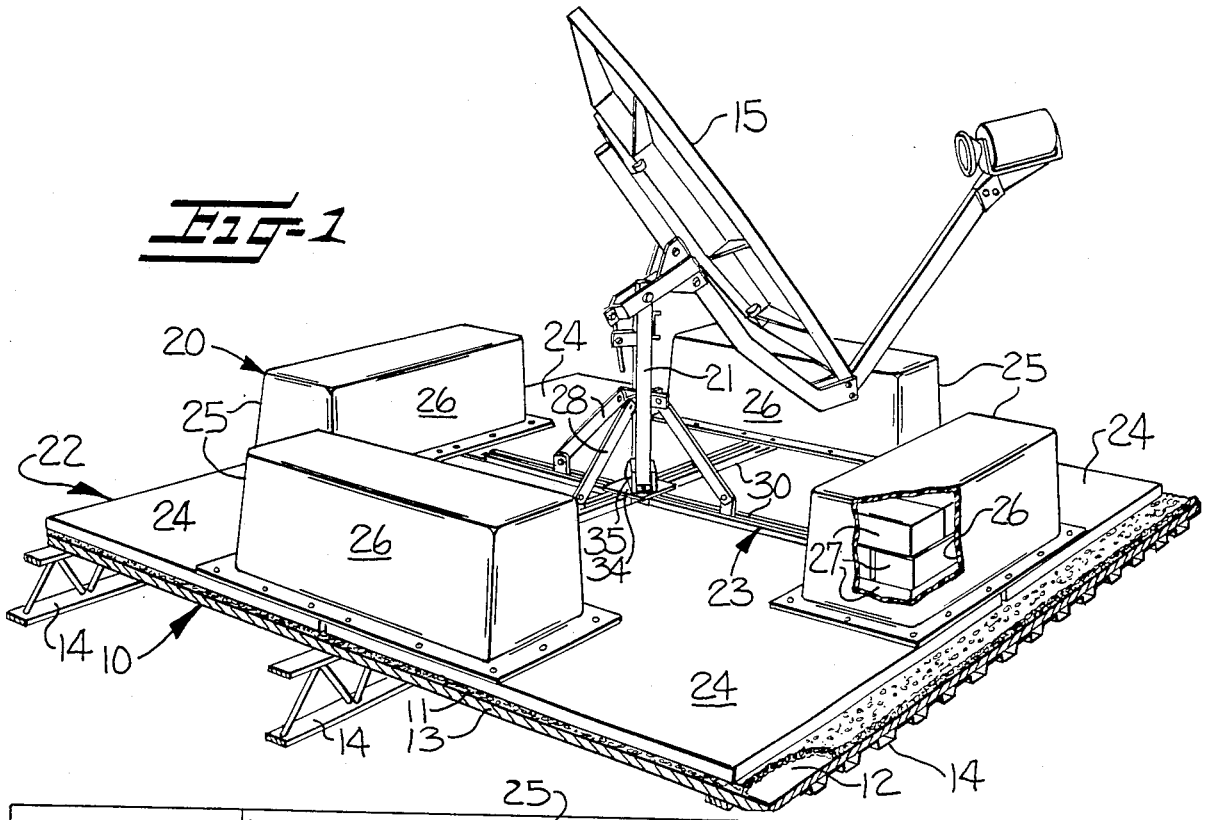
FIG. 1 is a perspective view of a first embodiment of a roof mount in accordance with the invention, shown installed on a flat roof, with a cutaway view of the ballast means, and a cutaway view of the roof illustrating the placement of the antenna mount over the steel joists supporting the roof.

FIG. 1 illustrates a first embodiment of an antenna mount 20 situated on a roof 10. The roof, which is depicted to illustrate the antenna mount in one possible application rather than to limit the scope of the invention to a particular roof construction, is comprised of a gravel surface 11, a waterproof membrane 12, a decking material 13, and a plurality of joists 14. The antenna mount 20, which is here illustrated carrying a typical dish antenna 15, is further comprised of an upright antenna support post 21, and a base 22.

Figure 2:
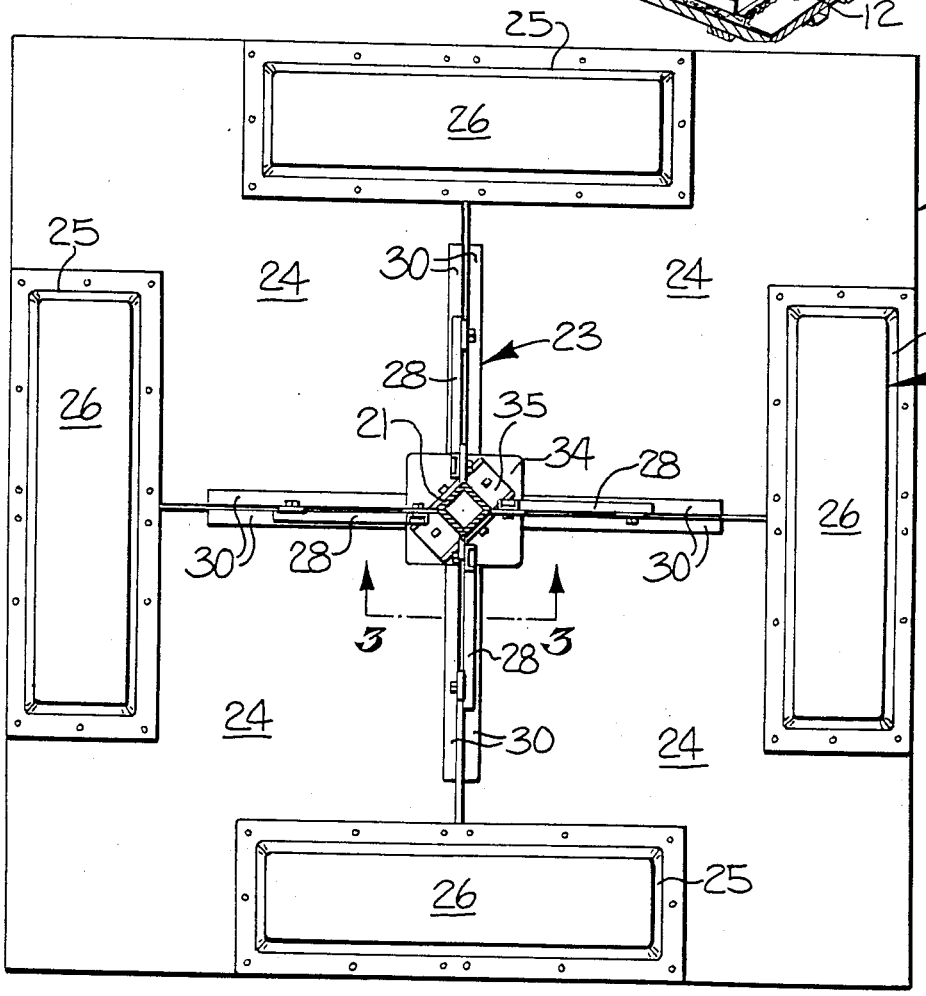
FIG. 2 is a top plan view of the roof mount of FIG. 1.

The base 22 is more fully illustrated in FIG. 2. The base is comprised of a framework structure 23, a plurality of panels 24, and a plurality of ballast means 25. The ballast means are integrally connected to the panels which carry them, and serve to interconnect and further rigidify the assembly of adjacent panels. The panels 24 are themselves constructed of a rigid material, preferably a structural laminate material such as a honeycomb structure. The base 22 is thereby sufficiently rigid to uniformly distribute the weight of the ballast means 25 being carried by the panels 24.

Returning to FIG. 1, the ballast means 25 are seen to be comprised of a ballast cover 26 and a ballast material 27. The ballast material is here illustrated as a plurality of bricks, but any relatively dense material would be satisfactory. Of course, a ballast material which is comprised of a number of relatively light individual units is most easily carried to a roof.

Also illustrated in FIG. 1 are the support struts 28, which interconnect the antenna support post 21 and the framework structure 23 to lend additional strength and rigidity to the support post 21.

Figure 4:
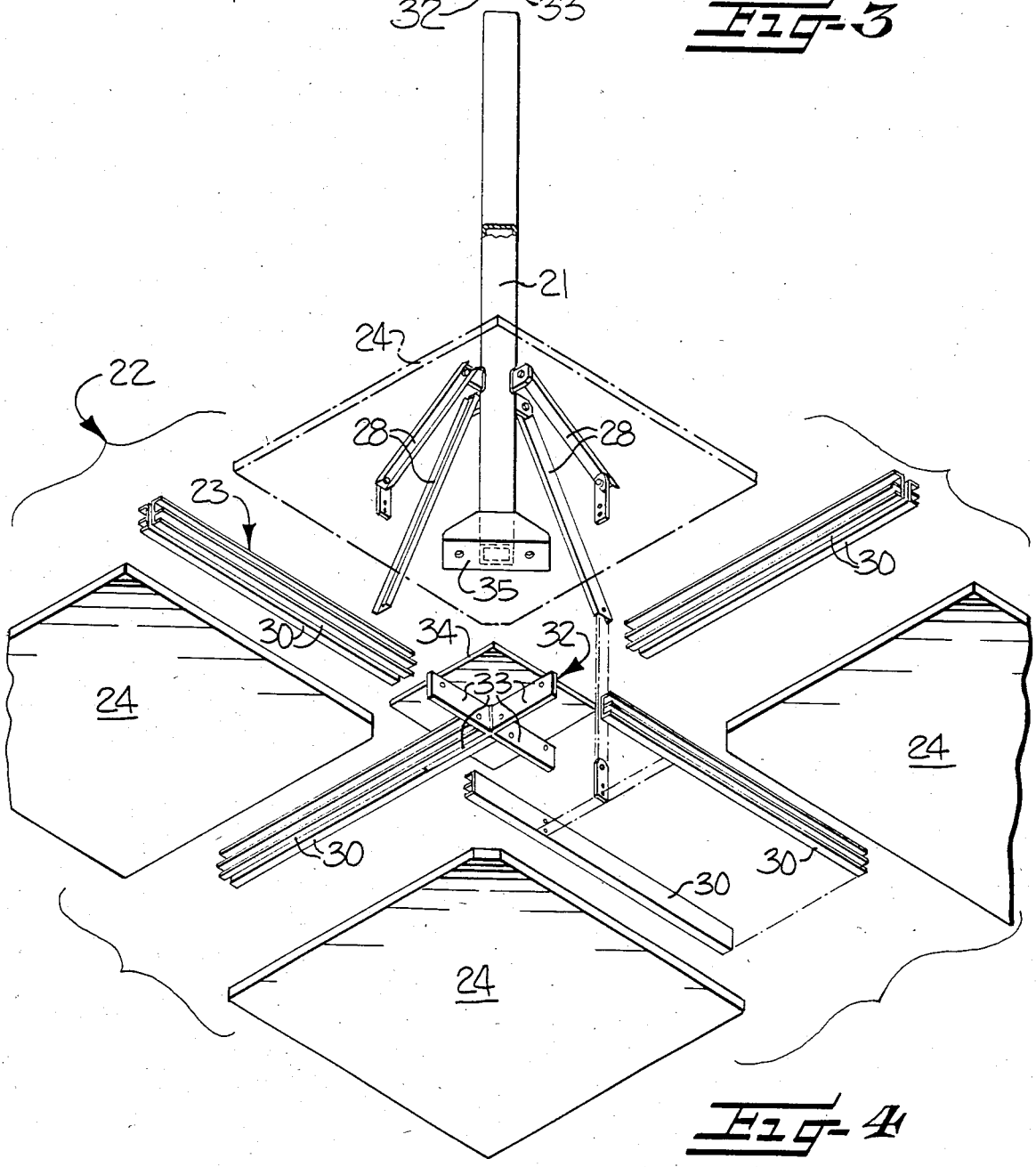
FIG. 4 is an exploded illustration of the roof mount, viewed from the underside.

The framework structure can be best understood with reference to FIG. 4. A plurality of channel members 30 are interconnected back-to-back to form a plurality of elongate frame members 31. To accomplish this interconnection, the channel members 30 are fastened to either side of an arm 33 of a junction section 32, which results in the channel sections being positioned in a spaced-apart relation from one another. A mounting plate 34 is secured to the top of the junction section 32.

Figure 3:
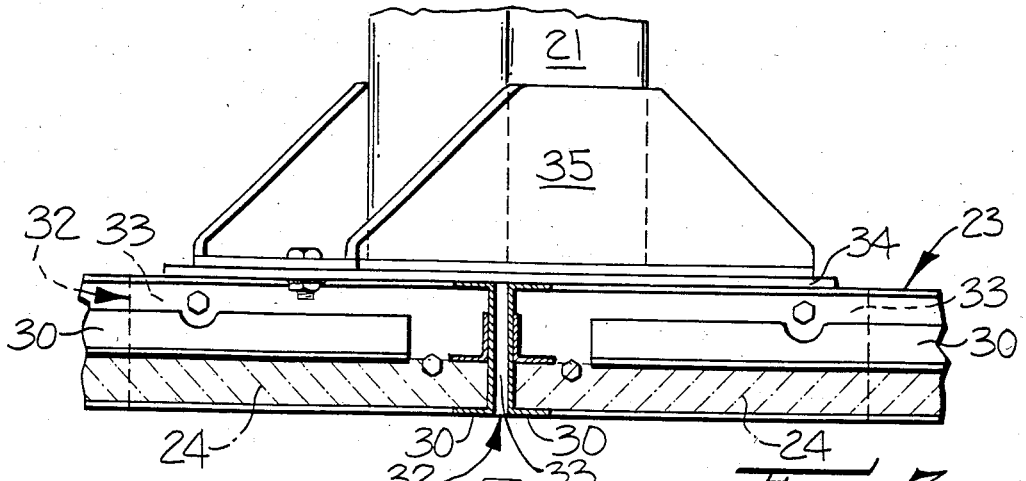
FIG. 3 is a fragmentary side cross-sectional view taken substantially along the line 3—3 in FIG. 2, and illustrating the connection of the upright mounting post to the base.

Turning to FIG. 3, an antenna support mounting bracket 35 can be seen connected to the mounting plate 34. The mounting bracket may be connected to the mounting plate by means of bolts, or by a welded connection. A bolted connection is preferred for greater collapsibility.

As is apparent from FIG. 2, the framework structure 23 does not extend to the outer edge of the rigid panels 24; instead, clearance is left so that the ballast covers 26 may be fastened directly to the panels 24. Since the panels are slidably received by the frame members 31 (see FIGS. 3 and 4), the interconnection of the panels 24 by the ballast covers 26 serves to maintain the edges of the panels 24 in their position within the channel members 30. Alternately, the panels could be fastened directly to the channel members.

The structural connections in the base are preferably temporary connections, such as may be made with bolts and screws, so that the base, and the antenna mount itself, is of a collapsible knockdown construction. Such a construction facilitates the transportation of the antenna mount to a roof, and its assembly thereon.

Figure 5:
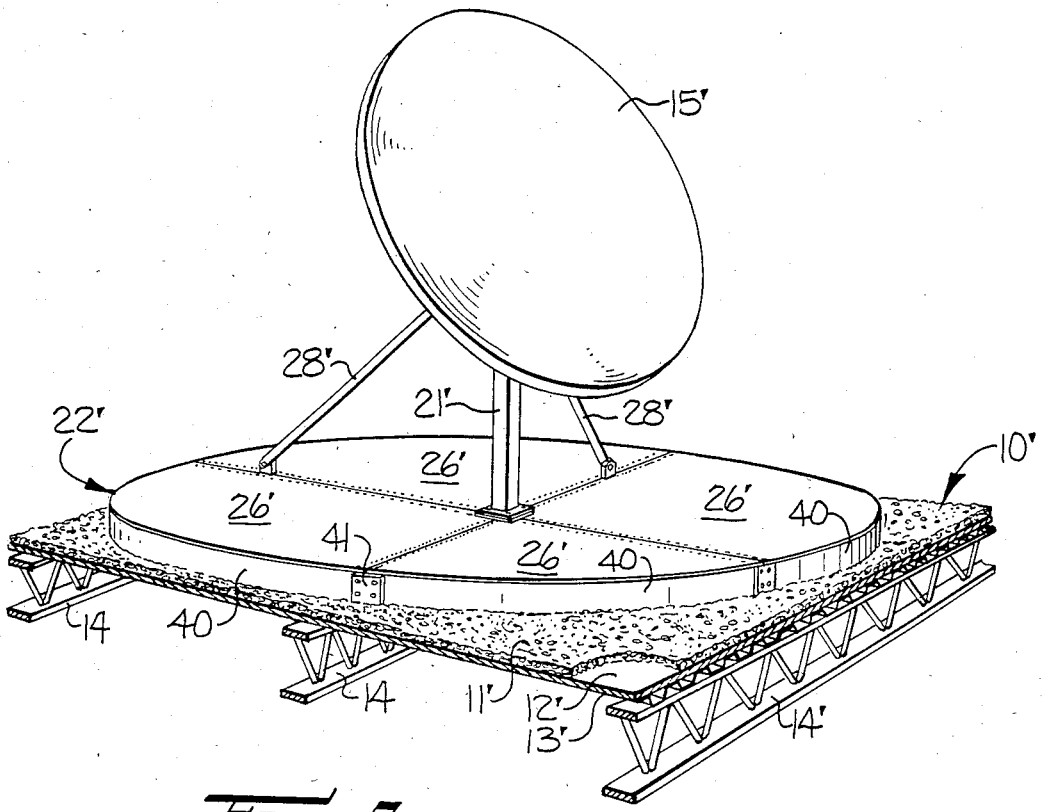
FIG. 5 is a perspective view similar to FIG. 1 showing a second embodiment of the invention.
Figure 6:
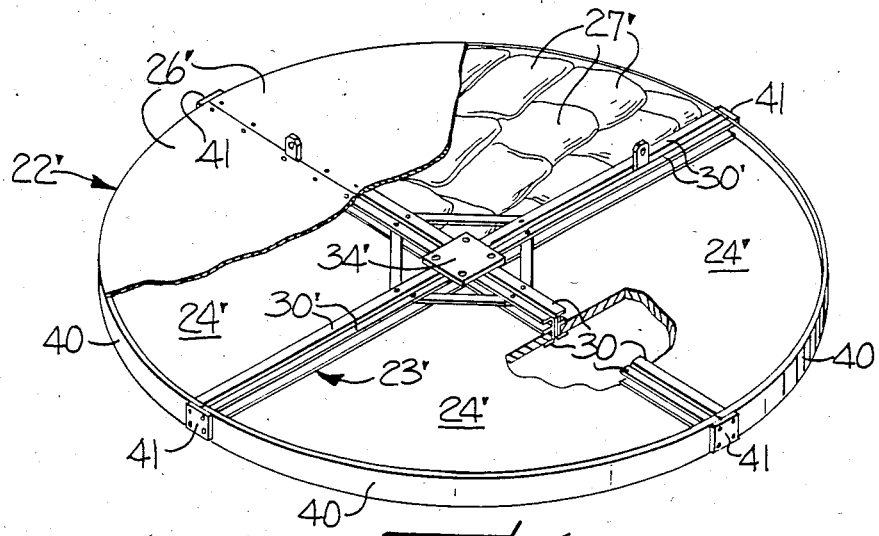
FIG. 6 is a cutaway view of the base of the roof mount of FIG. 5, illustrating the placement of the ballast means and the connection of the panels to the framework structure.

A second embodiment of the invention is illustrated in FIGS. 5 and 6 (The numbering used to explain this embodiment will parallel the numbering used for the first embodiment for all analogous structures). FIG. 5 reveals that the antenna mount 20′ is again comprised of an upright antenna support post 21′, a base 22′, and support struts 28′.

While the appearance of the base 22′ is different from the appearance of the base 22 of the first embodiment (see FIG. 1), the similarities in their construction are illustrated in FIG. 6. The base 22′ is again comprised of a framework structure 23′ and a plurality of rigid panels 24′. The ballast material 27′ is distributed across the entire surface of the panels 24′, and the plastic ballast covers 26′ are fastened directly to the framework structure 23′ so that the framework is largely concealed. In addition, a rim 40 is provided which surrounds the circumference of the base 22′. The rim is connected to the framework structure 23′ by means of rim connectors 41. In this embodiment, the ballast material 27′ is illustrated as being comprised of flexible containers, which may be filled with a suitable material such as a granular or liquid material.

Several important features of the invention are revealed in the foregoing embodiments. First, the height of the base is preferably no more than about 15% of the maximum lateral dimension of the base. The lateral dimension would be, for example, the diameter of a circular base (see FIG. 5) or the length of the side of a square base (see FIG. 1). The height of the base, making reference to FIG. 6, would be measured from the bottom of the panels 24′ to the top of the ballast covers 26′. This height to width ratio ensures the stability of the antenna mount.

Second, the lateral dimension of the base should preferably exceed the lateral dimension (or diameter) of any dish antenna mounted thereon to enhance the stability of the base. Finally, the lateral dimension of the base should preferably be large enough to overlie several of the joists supporting the roof on which the base is mounted so that sagging of the roof or the pooling of water on the roof is minimized.

The foregoing embodiments are to be considered illustrative rather than restrictive of the invention, and those modifications which come within the meaning and range of equivalents of the claims are to be included therein.

That which is claimed is:

1. An apparatus for mounting an antenna on a flat roof without penetrating the waterproof membrane of the roof, comprising a rigid base having a rigid and planar lower surface of relatively large cross-sectional area adapted to overlie the flat roof, ballast means carried by said rigid base for stabilizing the base, the weight of said ballast means being uniformly distributed over a large section of the roof by the rigidity and large cross-sectional area of said base, and antenna support means connected to and extending upwardly from said base for mounting an antenna thereon.

2. An apparatus according to claim 1 wherein said rigid base has a height dimension of no more than about 15% of the maximum lateral dimension.

3. An apparatus according to claim 1 wherein said rigid base is of a collapsible knockdown construction and comprises a plurality of rigid panels and means removably interconnecting said rigid panels.

4. An apparatus according to claim 3 wherein said plurality of rigid panels are positioned in side-by-side relation and said means interconnecting said panels comprises elongate frame members extending between and interconnecting said panels.

5. An apparatus for mounting a dish antenna on a flat roof without penetrating the waterproof membrane of the roof, comprising a dish antenna of predetermined cross-sectional area, an upright antenna support connected to and supporting said dish antenna, a rigid base connected to and supporting said upright antenna support, said rigid base having a rigid and planar lower surface and a cross-sectional area greater than that of said dish antenna, and ballast means carried by said rigid base for stabilizing the base, the weight of said ballast means being uniformly distributed over the roof by the rigidity and large cross-sectional area of said base.

6. An apparatus according to claim 5 wherein said rigid base is of a collapsible knockdown construction and comprises a plurality of rigid panels and means removably interconnecting said rigid panels.

7. An apparatus according to claim 6 wherein said plurality of rigid panels are positioned in side-by-side relation and said means interconnecting said panels comprises elongate frame members extending between and interconnecting said panels.

8. An apparatus according to claim 7, further comprising at least one brace extending angularly upwardly and interconnecting one of said frame members and said antenna support for rigidifying said antenna support.

9. In combination with a building of the type having a flat roof comprised of a plurality of roof joists mounted in parallel spaced-apart relationship, decking material carried by and supported by said roof joists, and roofing material defining a waterproof membrane, the improvement which comprises an antenna mount for mounting an antenna on the flat roof without penetrating said waterproof roof membrane said antenna mount comprising a rigid base having a rigid and planar lower surface and a relatively large cross-sectional area adapted to overlie a portion of the flat roof, the cross-sectional extent of said rigid base being such as to overlie a plurality of said spaced-apart roof joists, ballast means carried by said rigid base for stabilizing the base, the weight of said ballast means being uniformly distributed over a large section of the roof by the rigidity and large cross-sectional area of said rigid base, and antenna support means carried by and extending upwardly from said base for mounting an antenna thereon.

10. An antenna mount according to claim 9, wherein said rigid base is of a collapsible knockdown construction and comprises a plurality of rigid panels and means removably interconnecting said rigid panels.

11. An antenna mount according to claim 10, wherein said means removably interconnecting said rigid panels comprise frame members for receiving the edges of said panels.

12. An antenna mount according to claim 11, wherein said antenna support means comprises an upright antenna support post connected to said base.

13. An apparatus for mounting a dish antenna of predetermined cross-sectional area on a flat roof without penetrating the waterproof membrane of the roof, comprising a plurality of elongate frame members interconnected at one end in a central location, with the frame members extending radially outward therefrom, a plurality of rigid panels having planar lower surfaces, each of said panels having two adjacent sides received between and interconnected by adjacent pairs of said radially extending frame members, and said panels collectively forming a rigid base having a planar lower surface and a cross-sectional area greater than that of said dish antenna, an antenna support connected to said channel members and extending upwardly therefrom at said central location, a plurality of ballast units carried by said base, the weight of said ballast units being uniformly distributed over a large section of the roof by the rigidity and large cross-sectional area of said base.

14. An apparatus as claimed in claim 13, wherein each of said ballast units is carried by and interconnects two adjacent rigid panels.

15. An apparatus as claimed in claim 14, wherein said ballast units have a ballast cover, said ballast cover interconnecting said adjacent rigid panels.

16. An apparatus as claimed in claim 13, wherein each of said ballast units is carried by one of said rigid panels.

17. An apparatus as claimed in claim 16, further comprising a rim interconnecting the outwardly extended ends of said elongate channel members.

18. An apparatus for mounting an antenna on a flat roof without penetrating the waterproof membrane of the roof, comprising:

a rigid base having a rigid and planar lower surface of relatively large cross-sectional area adapted to overlie the flat roof, said base comprising a plurality of rigid panels positioned in side-by-side relation and elongate frame members extending between and interconnecting said panels;

ballast means carried by said rigid base for stabilizing the base, the weight of said ballast means being uniformly distributed over a large section of the roof by the rigidity and large cross-sectional area of said base; and antenna support means connected to and extending upwardly from said base for mounting an antenna thereon.

* * * * *